US010648264B2

(12) United States Patent
Cleven

(10) Patent No.: US 10,648,264 B2
(45) Date of Patent: May 12, 2020

(54) POSITIONING SYSTEM

(71) Applicant: COMITT WELL SOLUTIONS US HOLDING INC., Katy, TX (US)

(72) Inventor: Peter Kris Cleven, Grand-Barachois (CA)

(73) Assignee: Comitt Well Solutions LLC, Katy, TX (US)

( * ) Notice: Subject to any disclaimer, the term of this patent is extended or adjusted under 35 U.S.C. 154(b) by 68 days.

(21) Appl. No.: 15/888,861

(22) Filed: Feb. 5, 2018

(65) Prior Publication Data

US 2018/0156000 A1 Jun. 7, 2018

Related U.S. Application Data

(63) Continuation of application No. PCT/US2016/054157, filed on Sep. 28, 2016.

(51) Int. Cl.

| | |
|---|---|
| ***E21B 23/02*** | (2006.01) |
| *E21B 17/10* | (2006.01) |
| *E21B 47/09* | (2012.01) |

(52) U.S. Cl.

CPC ..... *E21B 23/02* (2013.01); *E21B 17/105* (2013.01); *E21B 17/1057* (2013.01); *E21B 47/0905* (2013.01)

(58) Field of Classification Search

CPC ..... E21B 23/02

USPC ..... 166/214

See application file for complete search history.

(56) References Cited

U.S. PATENT DOCUMENTS

| | | | | |
|---|---|---|---|---|
| 4,635,718 | A | 1/1987 | Thomas | |
| 4,979,561 | A | 12/1990 | Szarka | |
| 5,579,829 | A | 12/1996 | Comeau | |
| 2012/0006109 | A1 | 1/2012 | Anderson | |
| 2012/0103687 | A1* | 5/2012 | Saurer | E21B 7/061 175/45 |
| 2013/0008640 | A1 | 1/2013 | Epperson | |
| 2014/0367114 | A1 | 12/2014 | Weaterford | |

* cited by examiner

*Primary Examiner* — Taras P Bemko

(74) *Attorney, Agent, or Firm* — Pierson Intellectual Property LLC

(57) ABSTRACT

A system (100) for positioning a working tool (21) in a wellbore (1). The positioning system (100) comprises a casing element (110) with a marker (111, 112, 113) provided on an inner surface, the marker (111, 112, 113) having a distinct diameter different from the inner diameter of the casing element (110). The system further comprises a positioning tool (120) with a latching element (121, 122) adapted to form a latch (115) with the marker (111, 112, 113), and a force detector (130) adapted to detect an axial latching force ($F_L$) applied to a tubing string (20) from the latch (115) when the casing element (110) is located within the wellbore (1) and the force detector (130) is located at a surface (2) outside the wellbore (1).

12 Claims, 3 Drawing Sheets

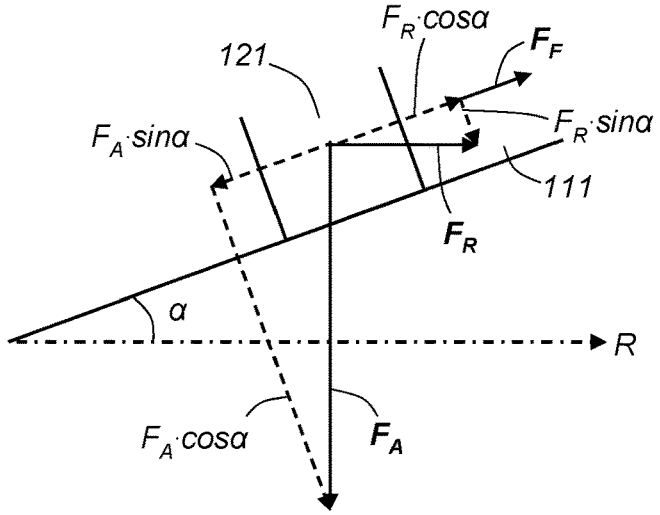
Fig. 5
Fig. 6a
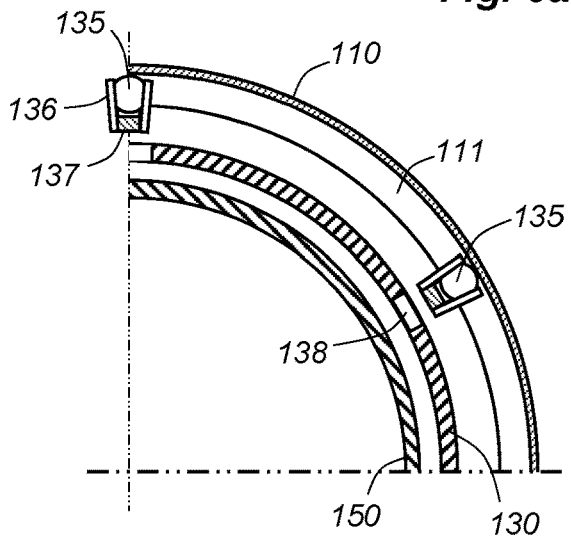
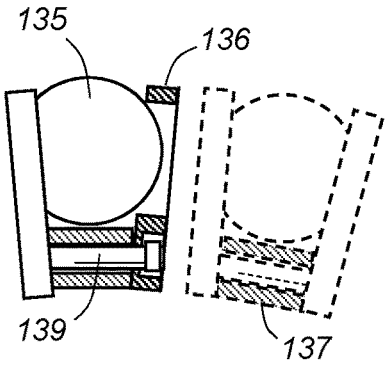
Fig. 6b
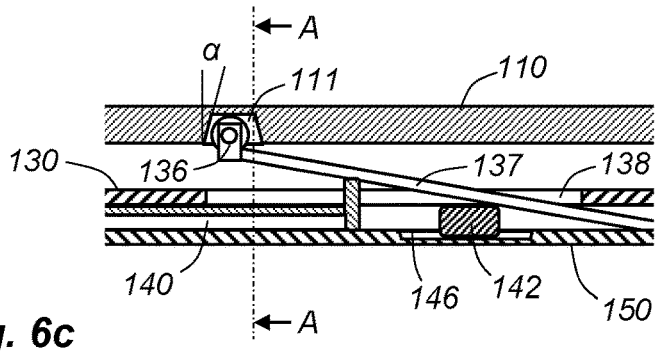
Fig. 6c

POSITIONING SYSTEM

BACKGROUND

Field of the Invention

The present application concerns a system for positioning a tool in a wellbore.

Prior and Related Art

The present invention may be used in wells in general, i.e. regardless of related field of technology. For example, the invention may be used in a well for exploration, production or injection in the oil and gas industry, similar wells in geothermal applications or a well for producing ground water. The terminology varies slightly between the fields of technology, and sometimes within each field. Thus, the next few paragraphs describe well known procedures to precisely define terms that are central to the present invention.

Creating a well starts by drilling a borehole through a geological formation, e.g. soil, sand, clay and rock of various kinds. The drilling may involve rotating a drill string with a drill bit on a downhole end while a drilling fluid is pumped down within the central bore of the drill string. The drill bit cuts material from the formation, and the cuttings, e.g. soil, sand or crushed rock, are conveyed by the drill fluid through the annulus between the drill string and the borehole to the surface. As the drill string advances into the borehole, standard lengths of pipe are added to the surface end of the drill string. In the following, the term "joint" means such a pipe or tubing element with a standard externally threaded pin at one end, and a box with complementary internal threads at the opposite end. Further, we will use the term "axial" consistently for the direction along the longitudinal axis of such a tubing element, i.e. never along the axis of some arbitrary guide or cylinder. Similarly, the terms "radial" and "circumferential" should be construed relative to the pertinent tubing element, not relative to some arbitrary cylinder or sphere.

When the borehole has the required depth, the drill string is retrieved and a steel tubing known as a casing is inserted into the borehole to prevent sand or rock from entering and blocking the borehole. The casing is usually made by adding joints to the surface end in the same manner as the drill string was extended, i.e. by means of standard pins and boxes.

In some applications, i.e. relatively shallow wells in all of the above industries, one drilling operation and one casing operation suffices. In deeper wells, e.g. most wells in the oil and gas industry, the first casing is cemented to the formation. When the cement has cured, a drill bit with a slightly smaller diameter is inserted through the casing. The drill bit is connected to a drill string, and may be driven by rotating the drill string as described above.

Alternatively, the drill bit may be rotated by a mud motor driven by the flow of drilling fluid through the central bore. When a new section is drilled, the drill string is retrieved, and a new casing with smaller outer diameter than the previous casing's inner diameter is inserted into the borehole and cemented to the formation. The sequence of drilling and casing is repeated with decreasing outer diameters to create a telescopic structure of casing. In some applications, the last section may remain uncased. The term "wellbore" as used herein means a partly or fully cased borehole, regardless of whether the casing is cemented to the formation or not. For example, a valve attached to a production string may be inserted through the casing to an uncased part of the wellbore.

In the oil and gas industry, there is a convention that a casing comprises tubing elements with outer diameter of 114.3 mm (4½ inches) and above. This convention does not necessarily apply to the present invention, e.g. in geothermal applications.

The drill bit may be steered in any direction relative to the Earth's crust by applying a suitable lateral force. An example is so-called "horizontal drilling" to provide a borehole that follows a layer containing hydrocarbons.

The terms "up" and "down" have different meanings in a vertical and a horizontal wellbore, and the terms "upstream" and "downstream" have different meanings during injection and production. In the following description and claims, we will use the term "uphole" for the direction toward the surface, regardless of any inclination relative to the vertical defined by gravity. As the term is used herein, "uphole" does not mean "at the surface". Similarly, in this description and the claims, "downhole" means the direction away from the surface, not "within the well(bore)".

Using the definitions above, the wellbore may comprise one or more casing sections. Each casing section comprises several joints with a standard outer diameter. If there are several casing sections, their outer diameters decrease in the downhole direction.

In any well, the casing merely isolates a fluid within from the geological formation around it. To complete a well, further operations and equipment are usually required. For example, a ground water well might comprise a production string with a pump and a valve to convey the ground water from a certain position along the casing to a location at the surface. Similarly, a production string with a throttle valve might be used in a geothermal application. In both examples, the production string with associated equipment may be retrieved from the wellbore for maintenance, while the casing remains in place and prevents soil, sand etc. from entering the well. In both examples, there is a need to position a valve at the location it had before the maintenance.

In a third example, fetched from the oil and gas industry, a perforation gun, e.g. connected to a wireline or a tubing string, creates perforations in the casing at geological layers containing hydrocarbons. After the perforation gun is retrieved to the surface, there may be a need to treat the surrounding formation, e.g. by hydraulic fracturing or acid stimulation, to enhance production. In general, treating a well involves inserting a tubing string with an injection valve into the wellbore and pump an injectant into the formation. In particular, radial openings of an injection valve should preferably align with the previously created perforation, and a section isolated by packers uphole and downhole from the perforation should be as short as possible. Such treatment is often repeated several times during the lifetime of a well. During production, similar radial openings in a production valve should preferably align with the perforation. Thus, there is a need to locate different working tools, here represented by the perforation gun, injection and production valves and packers, at a certain location several times during the lifetime of a well.

As a tubing string with a working tool may take slightly different paths through the wellbore each time it is used, measuring the inserted length of tubing string is inaccurate. The uncertainty increases with distance from the surface, and may easily become impractically large some kilometers along the wellbore. Similar problems are encountered during logging, e.g. using a wireline or slickline tool. Thus, today many or most tool strings and tools for cased wells in the oil and gas industry include casing-collar locators for depth control.

A casing-collar locator essentially detects distortions in a magnetic field when the tool passes a metallic collar arranged on the casing. More precisely, like-faced magnets may be placed on opposite sides of a sensing coil. A current is induced in the sensing coil when it passes the thicker metal at the casing-collar. The resulting current or voltage signal is amplified to a so-called "collar kick", which may be sent to the surface or stored locally in the tool. Either way, the distance from a casing-collar is much smaller than from the surface, so the casing-collar locator significantly improves the accuracy of depth measurements and positioning. However, casing-collar locators comprise a downhole amplifier and possibly other components that must be protected from the temperature, pressure and potentially corrosive fluids within the well. In addition, the components must be fast and precise to locate the casing collar precisely. Thus, a casing-collar locator tends to be relatively expensive and precise or less expensive and less accurate, so there is a need for a more accurate and less expensive positioning tool.

U.S. Pat. No. 9,097,079 discloses a fracturing port locator and isolation tool with dragging blocks that enter an annular groove caused by a shifted sliding sleeve, and thereby increases the dragging resistance. The tool comprises spring biased lugs, e.g. arranged on collet fingers, that expand radially into the annular groove created by a shifted sliding sleeve. The lugs may be arranged around the circumference of the tool with spaces between them to allow an axial flow.

The objective of the present invention is to provide a positioning system that is accurate, reliable and inexpensive to manufacture and operate, and that retains the benefits of prior art.

SUMMARY OF THE INVENTION

The objective is achieved by a positioning system according to claim 1.

More particularly, the invention provides a system for positioning a working tool in a wellbore. The positioning system comprises a casing element with a marker provided on an inner surface, the marker having a distinct diameter different from the inner diameter of the casing element. The system further comprises a positioning tool with a latching element adapted to form a latch with the marker and a force detector adapted to detect an axial latching force applied to a tubing string from the latch when the casing element is located within the wellbore and the force detector is located at a surface outside the wellbore.

The casing element preferably has length and threads similar to those of a standard joint in a casing section to facilitate inclusion in the casing section and installation in the wellbore. The latch may be any of four combinations of a radially movable element and a static element, of which one protrudes from a surface and the other has a complementary recess. As expected by the skilled person, the radially movable element may be activated by a spring force and/or a pressure.

The positioning system preferably comprises a spacer configured to adapt the axial distance between the latching element and the working tool to the axial distance between the marker and a desired position for the working tool in the wellbore. The spacer would be connected to the positioning tool, for example to ensure that radial ports in a valve align with a perforation made in a previous operation by a perforation gun with different length, and the latching element and marker form the same latch in both operations.

The positioning system also preferably comprises centering means configured to keep the positioning tool at a distance from the inner wall of the casing element. More specifically, the purpose of the centering means is to prevent the latching element from inadvertently engaging the marker. The centering means may be, for example, a leaf spring or a set of wheels or roller balls.

The axial extension of the latch may vary along the wellbore. For example, the axial lengths of annular grooves in the casing members could increase in the downhole direction such that a protruding latching member with a certain axial extension would pass a number of markers before it enters the first groove with sufficient length. Alternatively, protruding markers could have decreasing lengths in the downhole direction to achieve the same effect.

Preferably, the latch comprises a roller ball engaging walls that are inclined with respect to a radial plane. The purpose is to reduce the effect of friction between a solid lug and the inclined wall, in particular those caused by a well fluid lubricating steel surfaces, as the lubrication would depend on the well fluid and possibly local temperature and pressure. Alternatively, the engaging lug may be coated with a suitable material such as PTFE to reduce the friction and thereby the effects of the friction.

In preferred embodiments, the latch comprises a radially biasing spring. As "radial" in the present description and claims refers to the pertinent casing element, the implied spring force works to press the latching member toward the marker or vice versa. Thus, the biasing spring provides a radial spring force to ensure that the latching member and marker latches when aligned. In principle, a pressure exerted on a suitable piston area to move the piston radially would achieve the same effect.

However, pre-tensioning a spring is probably more accurate and convenient than controlling a pressure accurately to provide a suitable radial biasing force. Hence, the latch preferably comprises a tensioner configured to adjust the pre-tension of the biasing spring.

In preferred embodiments, the latch also comprises a piston area configured to increase the latching force, i.e. the axial force that can be detected at the surface. The latching force is proportional to a radial force pressing the latching element against the marker or vice versa. Thus, an increased pressure on a piston area may increase a radial force that, multiplied by a constant, provides an increased latching force. This may be used to vary the latching force along the wellbore by varying the pressure, and/or to ensure that the positioning tool is securely latched to the casing member when the pressure increases. In principle, the varying pressure might be the static pressure along the wellbore acting against a low pressure chamber.

However, in embodiments with such a piston area, the piston area is preferably exposed to a central bore within the positioning tool, as this allows adjusting the latching force by adjusting the bore pressure within the tubing string. The piston area exposed to the bore pressure is preferably larger than a piston area exposed to the annulus between the tubing string 20 and the casing 10, such that no air filled or other low pressure chamber is needed.

The piston area is also preferably opposed by a return spring. That is, a pressure force applied to the piston area and the spring force from the return spring work in opposite directions. Thereby, the spring force increases as the pressure increases to displace the piston area, and the piston area is pushed back by the return spring when the pressure decreases. The radially biasing spring may double as the return spring through an inclined surface, e.g. on the tensioner.

Further features and benefits may appear from the detailed description below.

BRIEF DESCRIPTION OF THE DRAWINGS

The invention will be explained with reference to exemplary embodiments and the accompanying drawings, in which:

FIG. 5 illustrates forces acting in a latch; and

FIGS. 6*a-c* illustrate a second embodiment of the system.

DETAILED DESCRIPTION OF A PREFERRED EMBODIMENT

The drawings are schematic and not necessarily to scale. Numerous details known to the skilled person are omitted from the drawings and following description. Furthermore, in the claims, the terms "a", "an" and "the" means "at least one" and "one" means exactly one, whereas terms such as "several" and "at least one" may be used in the following detailed description for ease of understanding.

Figure 1:
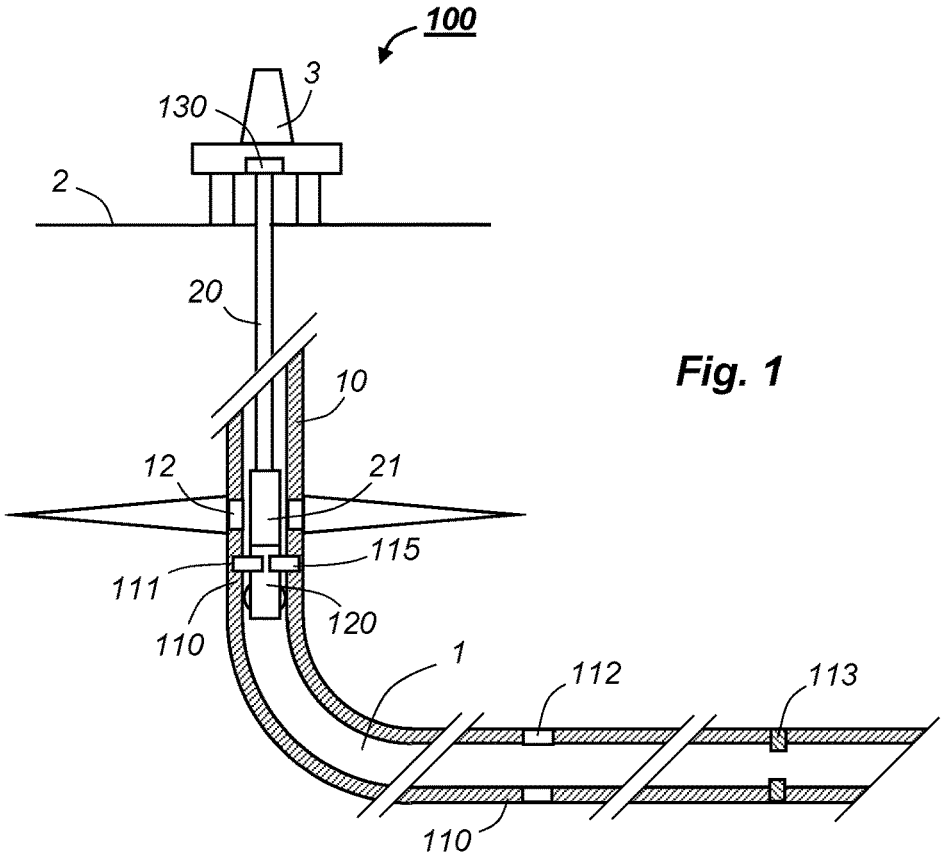
FIG. 1 illustrates main components in a system according to the invention.

FIG. 1 illustrates a system 100 according to the invention. Reference numerals above 100 refer to components of the system, whereas reference numerals below 100 are provided to explain the context of the system 100 in use, and are not part of the invention as such.

More particularly, FIG. 1 depicts a wellbore 1 extending vertically and horizontally through a geological formation. The wellbore 1 may be located onshore or offshore, and the surface 2 may thus be a sea surface or dry land. The wellbore 1 is lined with a casing 10, which comprises casing joints with different outer diameters and standard lengths, pins and boxes as explained in the introduction.

In use, one or more casing elements 110 according to the invention are included in the casing 10 at predefined locations. Casing elements 110 with different outer diameters may be provided in the system, e.g. for use in different sections in a "telescopic" casing as described in the introduction, or for use in different wells with different casing diameters.

Regardless of outer diameter, each casing element 110 in the system 100 has a marker 111, 112, 113 on an inner surface, and may be of any length. Preferably, the casing element 110 has the standard length and standard threaded pins and boxes as an adjacent casing joint to facilitate inclusion in the pertinent section of casing 10 and subsequent installation in the wellbore.

A tubing string 20 extends from a rig 3 on the surface 2 to a position identified by a marker 111 on the inner surface of the casing element 110. The downhole end of the tubing string 20 comprises a positioning tool 120 with a latching element (121, FIG. 2) adapted to form a latch 115 with the marker 111. Reference numeral 21 illustrate an interchangeable tool included in the tubing string 20. Using the third example in the introduction, reference numeral 21 may represent a perforation gun and an injection valve, such that FIG. 1 illustrates an injection valve 21 located at a perforation 12 previously made by a perforation gun 21. Using the same positioning tool 120 and latch 115 for the perforation gun and injection valve ensures precise positioning. In the future, the injection valve 21 may be repeatedly located within some decimeters of the same location for repeated treatment, e.g. hydraulic fracturing or acid stimulation. Between treatments, a production valve 21 may be accurately positioned at the perforation 12 by aligning the latching element 121 on the positioning tool 120 with the marker 111 to create the latch 115.

In FIG. 1, the interchangeable working tool 21 and the positioning tool 120 are shown with slightly greater diameter than the tubing string 20 for illustration. In a real embodiment, one or both of the tools 21 and 120 will often have the same diameter as the tubing string 20. Furthermore, the positioning tool 120 might be located uphole from the interchangeable working tool 21, and a suitable spacer (122, FIGS. 2 and 3) may be arranged between the positioning tool 120 and the working tool 21 to adapt the length of the tools assembly 21, 120 to an axial distance in the casing 10. For example, the length from the latching element 121 on the positioning tool 120 to radial openings in a sliding sleeve valve 21 should match the distance from the marker 111 to the perforation 12 made by the perforation gun 21.

When the latching element 121 on the positioning tool 120 engages the marker 111 in the casing 100, the resistance increases. More specifically, the axial force applied to the tubing string 20 increases by a latching force that should be easily detectable by a force detector 130 at the surface 2, e.g. in the rig 3. The required latching force depends on the force detector 130 and the distance between the surface 2 and the marker, e.g. markers 111, 112, 113. The latching force must be distinguishable from normal force variations that occur when inserting the string 20 into the wellbore 1, and could in some applications be in the range 50,000-100,000 N, roughly corresponding to the weight of 5-10 metric tons. However, the latching force depends on the application, so suitable latching forces below and above this range are anticipated.

Marker 112 illustrate an annular groove in the inner surface of a second casing element 110, and marker 113 illustrate a third alternative with a smaller diameter than the inner diameter of the casing element 110. Either way, the marker 112, 113 has a diameter that is distinct from the inner diameter of the casing element 110.

The marker 112 in FIG. 1 has a larger width, i.e. axial extension, than the uphole marker 111. This illustrates that the axial extension of grooves 111, 112 in some embodiments increases in the downhole direction, i.e. with the distance from the surface 2. In these embodiments, a radially biased lug 121 on the positioning tool might pass annular grooves 111 in the casing wall, and enter the first annular groove 112 with a sufficient width or axial extension. For the same effect, radially biased lugs 113 in the casing wall may enter a groove 123 in the outer wall of the positioning tool 120. In these alternative embodiments, the axial extension of the lugs 113 would decrease in the downhole direction. In the claims, these embodiments are combined in the expression "the axial extension of the latch varies along the wellbore".

Figure 2:
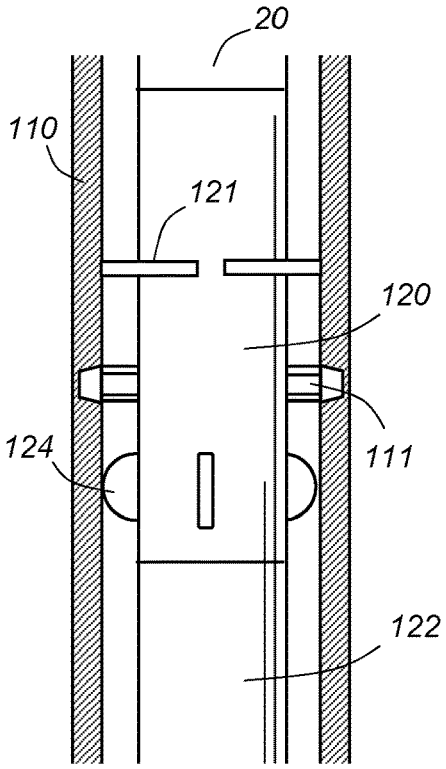
FIG. 2 illustrates embodiments with a spring biased member on a positioning tool.

FIG. 2 illustrates an embodiment with an outwardly radially biased latching element 121 mounted on the positioning tool 120 and a complementary annular groove 111 representing the marker in the inner wall of the casing element 110. The latching element 121 is shown as a split ring, also known as a C-ring, to illustrate that there are obvious alternatives to a lug 121 described with reference to FIGS. 4*a-c*. When the tubing string 20 is pushed further downhole such that the latching element 121 aligns with the marker 111, the radially biased latching element 121 expands into the groove 111. This forms the latch 115 (FIG. 1) and provides the required latching force mentioned above. The currently preferred embodiment comprises a radially biased latching element on the positioning tool, because the number of casing elements 110 is likely to be greater the number of positioning tools, and a radially biased element is expected to be more expensive than a groove.

Figure 3:
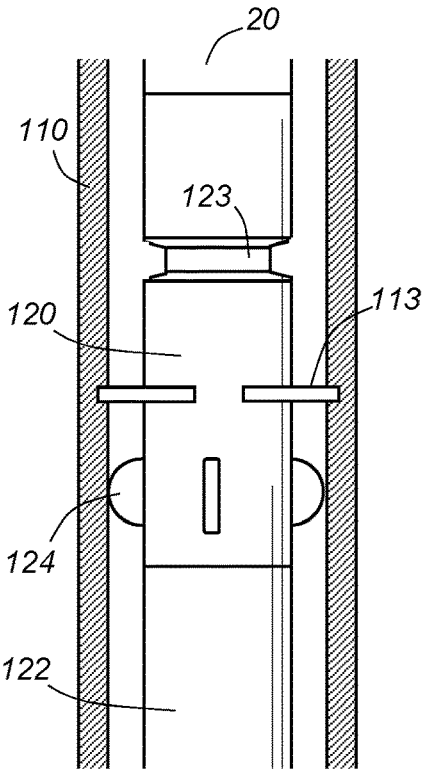
FIG. 3 illustrates embodiments with a spring biased member on a casing element.

FIG. 3 illustrates an embodiment similar to that shown in FIG. 2, but with an annular groove 123 around the positioning tool 120 representing the latching element 121 and an inwardly biased C-ring 113 mounted in the wall of casing element 110 representing the marker. While the embodiment in FIG. 2 is currently preferred, the embodiment in FIG. 3, possibly with a lug and/or collet fingers replacing the C-ring 113, is/are not excluded from the scope of the claims.

In contrast to the embodiment shown in FIG. 1, the positioning tools 120 in FIGS. 2 and 3 are connected directly to the tubing string 20 in their uphole ends and to a spacer 122 in their downhole ends. The spacer 122 is connected between the positioning tool 120 and the interchangeable working tool 21 (FIG. 1) to adjust the length of the tools assembly 21, 120 as described previously.

From the above, it should be understood that the system 100 comprises several casing elements 110, each provided with a marker 111, 112, 113, at least one positioning tool 120 with a latching element 121 or 123 capable of forming a latch 115 with a complementary marker 111, 113 and a suitable force detector 130. The force detector 130 is a commercially available device and need no further explanation herein. In addition, the system 100 includes zero or more spacers 122 to adjust the position of a working tool 21 relative to the latch 115 formed at a marker 111, 112, 113.

Optional centering means 124, e.g. wheels or leaf springs, are provided to guide the positioning tool 120 along the wellbore 1, i.e. to maintain a distance from the inner wall of the casing 10 to the tool assembly. More precisely, the purpose of the centering means 124 is to prevent or inhibit the latching elements 121 on the positioning tool 120 from inadvertently engaging the marker 111, 112, 113 on one side when moving through the wellbore, as such engagement may cause a false position reading. The centering means 124 may be provided on the positioning tool 120, on a spacer 122 or on a separate sub. The embodiment shown in FIG. 1 comprises centering means 124 at the downhole end of the positioning tool 120 to keep the tool assembly 21, 120 away from the inner surface of the casing element 110.

The latch 115 may be any of four combinations of a biased element and a static element, of which one protrudes from a surface and the other has a complementary recess. However, the physics involved is similar in each combination, so only one combination need a detailed description. Thus, the following detailed description regards embodiments wherein the marker 111 is an annular groove in the casing member 110 and the latching element 121 is a complementary biased and protruding element on the positioning tool 120.

Figure 4A:
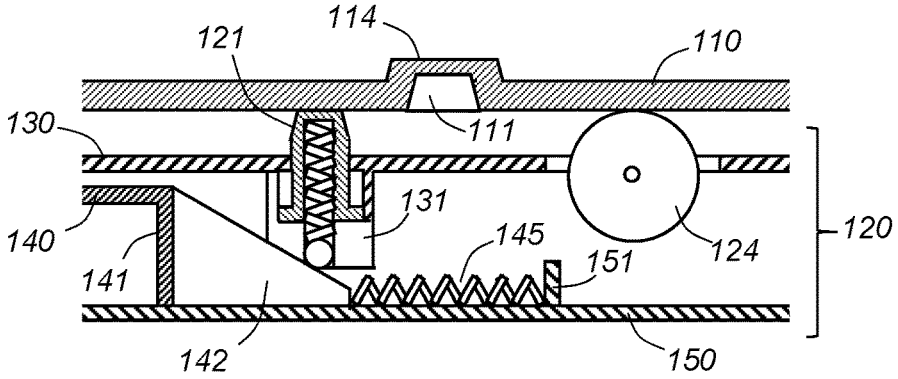
FIGS. 4*a-c* illustrate a first embodiment of the system in three states of operation.
Figure 4B:
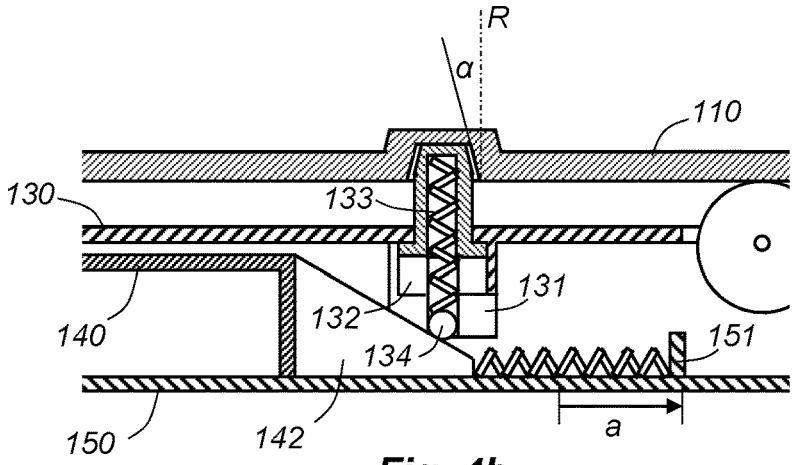
Figure 4C:
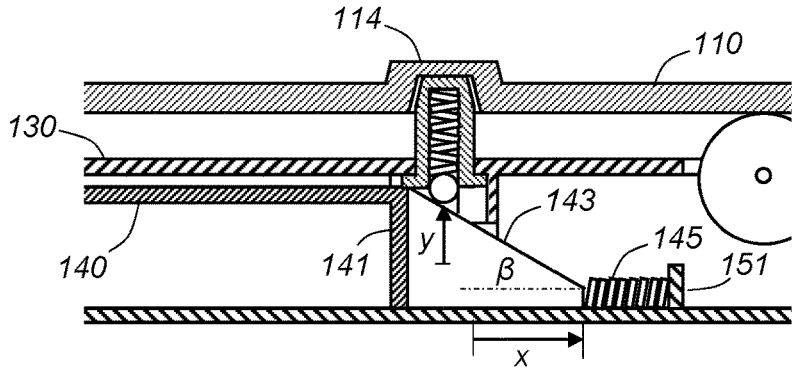

FIGS. 4*a-c* shows an embodiment of the positioning tool 120 in different states. More specifically, FIGS. 4*a-c* are sections through the casing element 110 and the positioning tool 120 on one side of a central cylinder axis along the positioning tool 120, and illustrate an embodiment with configurable resistance or latching force.

FIG. 4*a* illustrates the positioning tool 120 in a run-in state, in which a radially biased lug 121 approaches an annular groove 111 in a casing element 110. An optional casing collar 114 provides a radial extension or depth to the groove 111. Techniques for making and handling the casing collar 114 are well known in the art, e.g. from the electromagnetic casing-collar locators mentioned in the introduction.

The positioning tool 120 comprises a housing 130, a mandrel 150 fixed to the housing 130 and an optional piston 140 arranged radially between the housing 130 and the mandrel 150. The piston 140 may move axially relative to the housing 130 and mandrel 150. The centering means 124 maintains a distance between the positioning tool 120 and the inner wall of the casing element 110, and is shown as a wheel attached to the housing 130.

The housing 130 comprises a radial guide 131 for the lug 121. As shown, the guide 131 comprises a radial bore 132 with a biasing spring 133 arranged between the lug 121 and a support ball 134. The radial bore 132 has a section with extended diameter that limits the axial motion of the lug 121 by means of a collar, e.g. an external C-ring, on the lug 121. The extended diameter of the radial bore 132 is exaggerated to illustrate that a surface on the lug 121 may provide a piston area for a bore pressure. In such an embodiment, there would be a seal between the lug 121 and the part of the bore 132 with extended diameter, such that a bore pressure, i.e. below the lug 121 in FIGS. 4*a* greater than an ambient wellbore pressure, i.e. above the lug 121 in FIGS. 4*a-c*, would exert a net force toward the casing element 110. The resulting force would be a radial force component as the term "radial" is used herein.

The support ball 134 is configured to move within the radial bore 132, and engages an inclined surface 143 on a tensioner 142 such that an axial motion of the tensioner 142 causes a varying radial compression of the biasing spring 133.

For illustrative purposes, the guide 131 as shown comprises a slit, and the tensioner 142 is shown as a blade able to move axially within the slit. Numerous alternatives to achieve an adjustable biasing force will be apparent to the skilled person. For example, the guide 131 with the lug 121 may be simplified, and a frusto-conical tensioner 142 may replace the blade shown in FIGS. 4*a-c*. As noted, the piston 140 is optional. A frusto-conical tensioner 142 with threads engaging complementary threads on the mandrel 150 is described with reference to FIG. 6*c*, and would allow an operator to set a fixed bias on the lugs 121 before the positioning tool 120 is inserted into the wellbore 1.

In the example shown in FIGS. 4*a-c*, the tensioner 142 in the form of a blade is attached to the piston 140. The piston 140 has a piston area 141 exposed to a central bore through the positioning tool 120, i.e. the region below the mandrel 150 in FIGS. 4*a-c*. A return spring 145 arranged axially between the piston 140 and a stopper 151 on the mandrel 150 opposes a pressure force exerted on the piston area 141. Thus, a varying pressure in the central bore causes the piston 140 to move axially with respect to the housing 130, and hence the tensioner 142 to move relative to the radial guide 131.

FIG. 4*b* is not intended to show an actual state, but to illustrate that the biasing spring 133 expands, and thereby provides a smaller biasing force, when the lug 121 enters the groove 111 in the casing element 110. For this, the entire positioning tool 120, including the piston 140, has moved an axial distance a within the casing element 110 from the position shown in FIG. 4*a*, such that the support ball 134 is in the same radial position in FIG. 4*b* as in FIG. 4*a*. In reality, the piston 140 with tensioner 142 would probably be displaced axially with respect to the housing 130 due to variations in the bore pressure within the central bore.

The radial groove 111 has walls that are inclined in the axial direction. In FIG. 4*b* this is illustrated by an angle of attack α formed between a radial plane R and a sidewall of the annular groove 111. The axial pull or push required to retract the lug 121 from the groove 111 depend on the angle of attack α, the radial force applied to the lug and perhaps the friction between the lug 121 and groove 111 as further explained with reference to FIG. 5.

FIG. 4*c* shows the tensioner 142 axially displaced a distance x relative to the housing 130 and mandrel 150. This contracts the return spring 145 and provides an increased spring force on the piston assembly 140, 141, 142. It follows that the pressure exerted on the piston area 141 has increased from a circulation pressure implied by the run-in state illustrated in FIG. 4*a*.

In addition, the inclination β of the surface 143 to a central axis (not shown; parallel to the outer housing 130 in FIG. 4*c*) has caused the support ball 134 to move radially outward by a distance $y=x\cdot\tan\beta$ relative to its radial position in FIGS. 4*a* and 4*b*. This radial motion of the support ball 134 causes a contraction of the biasing spring 133 and an associated increase in the radial force applied to the lug 121.

FIG. 5 illustrates forces acting on a lug 121 in an annular grove 111 with inclined walls. More precisely, a side wall of the groove 111 forms an angle α with the radial plane R as shown in FIG. 4*b*. A radial force or bias $F_R$ is applied to the lug 121 in the radial direction into the groove 111. An axial force $F_A$ is applied to the lug 121 in the axial direction, i.e. parallel to the longitudinal axis through the casing element 110. $F_R$ and $F_A$ are decomposed in components parallel to and perpendicular to the inclined sidewall, respectively.

The lug 121 does not move transverse to the sidewall, so there must be a normal force with magnitude ($F_A\cdot\cos\alpha+F_R\cdot\sin\alpha$) directed opposite the components of $F_R$ and $F_A$ in the transverse direction.

In the parallel direction, $F_A$ provides the only component pointing out of the groove 111, i.e. $F_A\cdot\sin\alpha$. This component must overcome the component $F_R\cdot\cos\alpha$ from the radial bias and, in a general case, an additional friction force $F_F$ proportional to the normal force, i.e. $F_F=\mu\cdot(F_A\cdot\cos\alpha+F_R\cdot\sin\alpha)$ where μ is a static coefficient of friction. Thus, the condition for moving the lug 121 out of the groove 111 is:

$$F_A\cdot\sin\alpha>F_R\cdot\cos\alpha+\mu\cdot(F_A\cdot\cos\alpha+F_R\cdot\sin\alpha) \quad (1)$$

Setting $F_R=0$ in equation (1), yields $\tan\alpha>\mu$ regardless of axial force $F_A$. This sets a minimum angle of attack α, which may be illustrated by α=0: No practical axial force moves a lug past a truly radial steel wall.

Dividing all terms in equation (1) with cos α and rearranging yields:

$$F_A > F_L = \frac{1+\mu\cdot\tan\alpha}{\tan\alpha-\mu}\cdot F_R = C\cdot F_R \quad (2)$$

We note that tan α must be truly greater than μ to avoid a zero denominator, and that the latching force $F_L$ is proportional to the radial force $F_R$. Thus, the proportionality constant C is easily determined by calculation using equation (2) if α and the static coefficient of friction μ are known, or by measuring the ratio $F_L/F_R$ directly. This value C scales the latching force $F_A$ over a wide range of radial forces $F_R$.

The static friction, i.e. μ, between steel surfaces may vary over a large range depending on the lubrication provided by the well fluid, which in turn may depend on temperature and pressure. Thus, it would be advantageous to reduce the dependency on friction. This may be achieved by reducing the friction to an insignificant level. Setting μ=0 in equation (2) yields:

$$F_A > F_L = \frac{1}{\tan\alpha}\cdot F_R = C_0\cdot F_R \quad (3)$$

The coefficient of friction may be reduced by coating the lug 121 with a suitable material, e.g. PTFE.

FIGS. 6*a* and 6*b* illustrate an embodiment where a roller ball 135 replaces the lug 121 to reduce the static friction. More precisely, FIG. 6*a* is a cross section along the plane A-A in FIG. 6*c*, and shows two of several fingers 137 distributed around the housing 130. Each finger 137 may be resilient, and provide a radial spring force on the roller ball 135 toward the annular groove 111 similar to the spring force from the radial spring 133 on the lug 121 in the previous example. Alternatively, the fingers 137 may be rigid, hinged to the mandrel 150 and biased by a separate spring 133 as the one shown in FIGS. 4*a-c*. The housing 130 has one or more longitudinal openings 138 such that the fingers 137 can move radially with respect to the housing 130.

FIG. 6*b* illustrates a possible arrangement for mounting the roller balls 135, in which each ball 135 is retained on a distal end of its associated finger 137 by two holders 136. Each holder 136 is essentially a plate with a first bore to receive part of the ball 135 and a second bore to receive a hinge element 139, e.g. a bolt, which couples the two holders 136 to the finger 137. A stopper (not shown) between the holder 136 and finger 137 is required to prevent the holder 136 from pivoting freely about the hinge element 139. This is perhaps best seen in FIG. 6*c*: If the holder 136 was allowed to pivot freely about the distal end of the finger 137, the roller ball 135 would not engage the walls with inclination α properly when an axial force is applied, and hence no proper latching force would be provided.

Clearances shown between the roller ball 135 and holder 136 in FIG. 6*b* are intended to allow the roller balls 135 to rotate in any direction and to allow a small particle to pass.

In principle, the fingers 137 and associated roller balls 135 could be closely spaced as indicated by the dotted finger and roller ball. For example, the angular displacement of adjacent fingers 137 could be 10° as indicated in FIG. 6*b*, yielding 36 roller balls and 72 holders distributed along the circumference. A latching force of 10 metric tons would then exert a weight of 140 kg, i.e. less than 1.4 kN, on each holder 136. Accordingly, the roller balls 135 and holders 136 might be made of relatively inexpensive materials and be designed for regular replacement.

However, a currently preferred embodiment comprises far less than 36 roller balls, e.g. six as implied by FIG. 6*a*, to allow an axial fluid flow between the fingers 137 and to reduce the number of movable parts. Finding a suitable balance between a large number of inexpensive parts and fewer, potentially more expensive, parts is a design issue left to the skilled person.

FIG. 6*c* shows the casing element 110 with its annular groove 111, the housing 130, piston 140 and mandrel 150 as in the embodiment shown in FIGS. 4*a-c*. In contrast to the previous embodiment, the tensioner 142 is not attached to the piston 140, but engages threads 146 on the mandrel 150 such that a relative rotation causes an axial displacement of the tensioner 142 with respect to the mandrel 150. Thus, the tensioner 142 can be rotated on the mandrel 150 to provide a preset angle or bias to the finger 137. For example, an operator at the surface 2 may adjust the angle of the fingers 137 such that the roller balls 135 provide the optional centering means 124 described above. Alternatively, the tensioner 142 may be rotated on the mandrel 150 to permit the roller balls 135 to retract fully into the housing 130.

The piston 140 produces a radial force component on the spring 137 depending on the bore pressure as explained with reference to FIGS. 4*a-c*. A return spring 145 similar to that shown in FIGS. 4*a-c* may be provided in a real embodiment, but is omitted from FIG. 6*c* for simplicity. The radial force applied to the roller ball 135 as function of the axial positions of the piston 140 and the tensioner 142 on the mandrel 150 may be measured directly and/or calculated using known formulas for a spanned beam 137. Such measuring and/or calculation is/are within the abilities of the skilled person, and thus need no further explanation.

Another obvious embodiment would be to mount roller balls 135 and holders 136 on the lug 121 in FIGS. 4*a-c*.

In FIG. 6*a*, the openings 138 are shown as discrete longitudinal slits in the housing 130 for illustration. FIG. 6*c* shows that the mandrel 150 connects the uphole and downhole parts of the positioning tool. Implementing the opening 138 by connecting separate uphole and downhole parts of the housing 130 to the mandrel 150 might be less expensive and more practical than providing several discrete slits 138 in the housing 130 as shown in FIG. 6*a*.

Continuing the example with inexpensive and easily replaceable roller balls 135 and holders 136, we note that the distal end of finger 137 may move a considerably longer radial distance than the proximal end at the right hand side of FIG. 6*c*. Hence, the fingers 137 may be permanently attached to a collet (not shown). If a collet with fingers 137 is significantly more expensive than the roller balls 135 and holders 136, the fingers 137 may alternatively be separated to facilitate the replacement. After replacement, the separate fingers may be aligned, and a wire string inserted through holes near their proximal ends. Then the ends of the wire string might be connected to form a continuous ring for ease of handling when the fingers 137 are arranged around the mandrel 150 and clamped in place, e.g. between the edge of opening 138 and the tensioner 142 as shown in FIG. 6*c*. In contrast, replacing the hinge elements 139 at the distal ends of the fingers 137 with a continuous wire string would be impractical. For example, a flexible wire string may fit the large diameter of the annular groove 111, but would be unable to retain the holders 136 within the housing 130 in a retracted state.

Summarized, preferred embodiments provide a radial force $F_R$ with a spring component and a pressure component. A minimum spring component can be preset by tensioning a spring 133, 137 by a tensioner 142. The radial pressure component can be used to provide a variable radial force, and thereby a pressure dependent latching force $F_L$ according to equation (2) or (3). Thus, the latching force $F_L$ may be adjusted along the wellbore if desired. Alternatively, the adjustable latching force might just ensure that the latch 115 is properly set after a suitable increase in bore pressure, for example at an injection pressure substantially higher than a circulation pressure applied during run-in.

While the invention has been explained by means of examples and certain embodiments, the scope of the invention is defined by the accompanying claims.

The invention claimed is:

1. A system for positioning a working tool in a wellbore, wherein system comprising:

a casing element with a marker provided on an inner surface of the casing element, the marker having a distinct diameter different from the inner diameter of the casing element, the marker having a first inclined wall positioned on a proximal end of the marker, the first inclined wall having a first angle;

a positioning tool coupled to the working tool with a spring and latching element adapted to form a latch with the marker, wherein the positioning tool and the working tool are pushed downhole together in the same tubing string, wherein an amount of force to detach the latching element from the marker in a first direction is determined based on the first angle, the spring compressing and elongating in a direction perpendicular to a central axis of the working tool to apply an axial force in the direction perpendicular to the central axis of the working tool against the latching element to form the latch between the latching element and the marker when the latching element and the marker are vertically aligned;

a housing of the positioning tool with a radial bore to control an axial movement of the latching element responsive to the spring elongating to apply the axial force in the direction perpendicular to the central axis of the working element against the latching element, wherein the latching element and the spring extend through the radial bore when the latch is formed between the latching element and the marker;

a force detector adapted to detect an axial latching force applied to a tubing string from the latch when the casing element is located within the wellbore and the force detector is located at a surface outside the wellbore; and a centering tool coupled to the positioning tool configured to maintain a distance from an outer circumference of the positioning tool and an inner circumference of the casing element while the working tool is moving through the wellbore and to maintain the distance from the outer circumference of the positioning tool and the inner circumference of the casing element when the latching element forms the latch with the marker, the centering tool contacting the inner circumference of the casing element when the latching element is latched and unlatched with the marker.

2. The system according to claim 1, further comprising centering means configured to keep the positioning tool at a distance from the inner wall of the casing element.

3. The system according to claim 2, wherein the axial extension of the latch varies along the wellbore.

4. The system according to claim 3, wherein the latch comprises a roller ball engaging walls that are inclined with respect to a radial plane.

5. The system according to claim 1, wherein the latch comprises a piston area configured to increase the latching force.

6. The system according to claim 5, wherein the piston area is exposed to a central bore within the positioning tool.

7. The system according to claim 6, wherein the piston area is opposed by a return spring.

8. The positioning system according to claim 1, wherein the positioning tool is positioned uphole from working tool.

9. The positioning system according to claim 1, wherein the positioning tool is positioned downhole from the working tool.

10. The positioning system of claim 1, further including:

a plurality of positioning tools.

11. The positioning system of claim 10, further including:

a plurality of markers configured to interface with different positioning tools.

12. A system for positioning a working tool in a wellbore, wherein system comprising:

a casing element with a marker provided on an inner surface of the casing element, the marker having a distinct diameter different from the inner diameter of the casing element;

a positioning tool coupled to the working tool with a latching element adapted to form a latch with the marker, wherein the positioning tool and the working tool are pushed downhole together in the same tubing string; and a force detector adapted to detect an axial latching force applied to a tubing string from the latch when the casing element is located within the wellbore and the force detector is located at a surface outside the wellbore, wherein the latch comprises a radially biasing spring, wherein the latch comprises a tensioner configured to adjust the pre-tension of the biasing spring.

* * * * *